US011332984B2

(12) United States Patent
Mahbod et al.

(10) Patent No.: US 11,332,984 B2
(45) Date of Patent: May 17, 2022

(54) SLIDING STANDOFF ASSEMBLY

(71) Applicant: FAST FOWARD TECHNOLOGY LLC, Lewisville, TX (US)

(72) Inventors: Pouya Mahbod, Lewisville, TX (US); Jeffrey Bruce Wensrich, Houston, TX (US); Sam Schroit, Houston, TX (US)

(73) Assignee: Fast Forward Technology LLC, Lewisville, TX (US)

( * ) Notice: Subject to any disclaimer, the term of this patent is extended or adjusted under 35 U.S.C. 154(b) by 81 days.

(21) Appl. No.: 16/872,917

(22) Filed: May 12, 2020

(65) Prior Publication Data

US 2021/0355760 A1 Nov. 18, 2021

(51) Int. Cl.
*E21B 17/10* (2006.01)
*E21B 43/12* (2006.01)

(52) U.S. Cl.
CPC ..... *E21B 17/1071* (2013.01); *E21B 17/1014* (2013.01); *E21B 43/127* (2013.01); *E21B 2200/08* (2020.05)

(58) Field of Classification Search
CPC ..... E21B 17/1071; E21B 17/1014; E21B 17/1021
See application file for complete search history.

(56) References Cited

U.S. PATENT DOCUMENTS 735,690 A * 8/1903 Alvord ..... E21B 17/1071 166/241.2
1,801,294 A * 4/1931 Sutton ..... E21B 17/1057 166/241.3
2,841,226 A * 7/1958 Conrad ..... E21B 17/1028 166/213
5,692,562 A * 12/1997 Squires ..... E21B 17/1064 166/241.3
5,740,862 A * 4/1998 Sable ..... E21B 17/1064 166/241.2
2016/0084021 A1* 3/2016 Jewett ..... E21B 47/13 166/302

* cited by examiner

*Primary Examiner* — Giovanna Wright
(74) *Attorney, Agent, or Firm* — Law Office of Jeff Williams PLLC; J. Oliver Williams

(57) ABSTRACT

Embodiments of the present invention disclose a standoff assembly for a sucker rod used for sucker rod pumps. The assembly includes an annulus body, a hole that passes through the annulus body, the hole configured to permit a sucker rod to translate through the hole, a sliding material component located along the surface of the hole, and a temporary component; wherein upon elimination of the temporary component, the sliding material component interacts with the sucker rod to reduce sliding friction as the sucker rod translates through the assembly.

17 Claims, 13 Drawing Sheets

SLIDING STANDOFF ASSEMBLY

BACKGROUND

1. Field of the Invention

The present disclosure relates generally to a method for isolating sucker rods from the production tubing and an associated device enabling such isolation.

2. Description of Related Art

One of the most common methods of extracting liquid resources from a well, such as an oil well, is artificial lift. The most common type of artificial lift pump system applied is beam pumping, which engages equipment on and below the surface to increase pressure and push oil to the surface. Consisting of a sucker rod string and a sucker rod pump, beam pumps are the familiar jack pumps seen on onshore oil wells. General setup of a sucker rod pump for a well consists of sucker rods and sucker rod connections that are used to connect the sucker rod pump downhole. Rods generally come in predetermined lengths and are screwed together and lowered inside the well to reach the desired depth.

Beam pumps supply an up and down motion through the sucker rods to the sucker rod pump that in turn lifts liquids from depths below. However, friction between the rods and tubing that encases the well hole causes the surface motor to work harder to overcome the friction, thus resulting in wasted energy that is not used in lifting resources from the well. Currently, in order to reduce friction and avoid mechanical wear and tear to tubing that encases the well hole, a rubber standoff or centralizer is molded to the rod. The standoff functions to reduce friction forces predominantly acting along the long axis of a bore hole and may also function to reduce friction forces acting in other directions, including but not limited to; for example, across the long axis of the bore hole if the rod is rotating relative to the tubing. Alternatively, a roller centralizer is connected between two adjacent rod sections. However, there are several drawbacks to these solutions as they do not isolate the rod well enough in order for a user to place sensors and measurement devices such as pressure sensors down hole, as the user will need an additional conductor cable to run alongside the rods. Therefore, it is desired to develop a device that can reduce the amount of force required to slide a rod along long distances inside tubing/casing, reduce wear and tear on respective components, and also provide electrical isolation such that the rods can be used as a conductor to transmit power and signals.

SUMMARY OF THE INVENTION

Embodiments of the present invention disclose a standoff assembly for a sucker rod used for sucker rod pumps. In one embodiment of the present invention, an assembly is provided having an annulus body having a first surface and a second surface, the first surface having an outer diameter, the second surface corresponding to a hole that passes through the annulus body, the hole having an inner diameter configured to permit a sucker rod to translate through the hole, a sliding material component located along the second surface and a dissolvable component disposed to allow the sliding material component to interact with the sucker rod upon dissolving. In a further embodiment, the assembly additionally comprises an energy storage component, and a friction component designed to interact with an inner surface of a tubular and restrict motion of the assembly relative to the tubing.

In an embodiment, the standoff assembly is a split assembly to facilitate securing to a sucker rod, a first half of the assembly disposed to secure to the second half.

In an embodiment, the energy storage component is a spring disposed to actuate a friction component radially towards the inner surface of a tubular and actuate the sliding material component in an opposing radial direction to interact with the sucker rod.

Ultimately the invention may take many embodiments. In these ways, the present invention overcomes the disadvantages inherent in the prior art.

The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions in so far as they do not depart from the spirit and scope of the present application.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
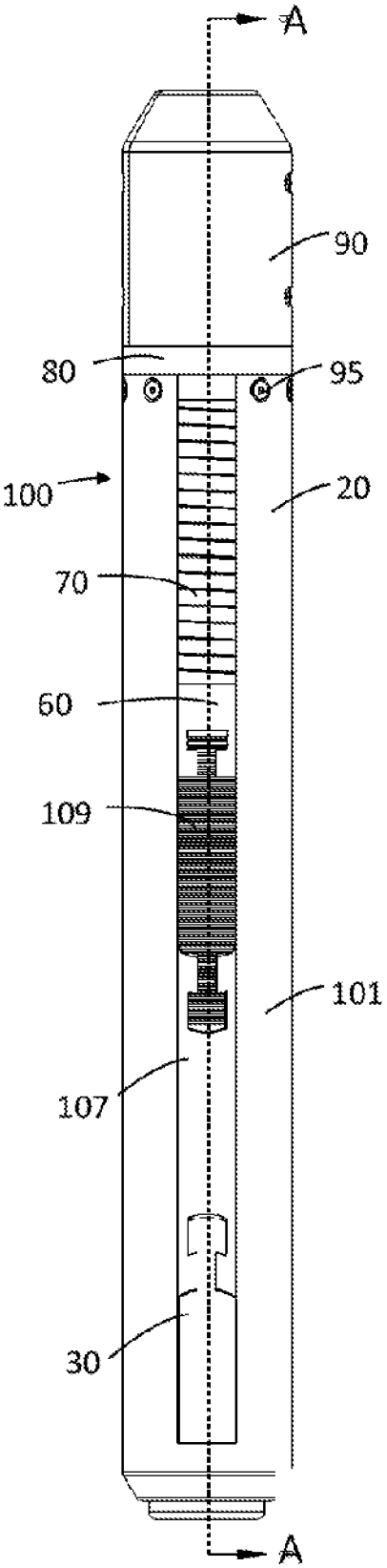
FIG. 1 is a view of a standoff assembly in accordance with an embodiment of the present invention.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The assembly and method in accordance with the present invention overcomes one or more of the above-discussed problems associated with typical standoffs in the art for sucker rods. In particular, the system of the present invention is a standoff for a sucker rod that reduces friction between the rod and well tubing, avoids premature failure of the rod connectors and extends the lifetime of the rod, provides an electrical isolation of the rod to the casing that can be used for sending power and/or communication to downhole tools without the need of an additional wire to connect surface equipment to downhole tools, and can be used over a body which provides better friction reduction than online only rollers.

The assembly includes, but is not limited to, an annulus body, a sliding material component that lines or partially lines a surface of a hole passing through the annulus body, and a temporary component that restricts the annulus body and standoff assembly from further interacting with the sucker rod. The temporary component may be made of a plastic or metal material that dissolves after a period of time or degrades after a certain number of cycles of a sucker rod pop. Alternatively, the temporary component may be a material that breaks down in response to an electrical discharge. Upon dissolving, elimination or degradation of the temporary component, the standoff assembly permits the sucker rod to further interact with the assembly through the hole of the annulus body wherein the sliding material component between the annulus body and the sucker rod minimizes friction forces as the sucker rod translates, rotates or moves in a combination thereof. These and other unique features of the system are discussed below and illustrated in the accompanying drawings.

In an embodiment, a standoff assembly is provided for use within a well bore that extends into a subterranean formation; the standoff assembly disposed to allow translation of a sucker rod therethrough and comprises; a sliding material component, a friction component and a temporary component; wherein the friction component interacts with a surrounding tubular; and upon elimination of the temporary component, the sliding material component interacts with the sucker rod.

In an alternate embodiment, the friction component interacts with the surrounding tubular upon elimination of the temporary component.

In an embodiment a plurality of friction components and sliding material components are circumferentially located about the standoff assembly. For example; two, three, four, five, six, seven, eight, nine, ten or more friction components and for example; two, three, four, five, six, seven, eight, nine, ten or more sliding material components.

In an embodiment, the friction components are rubber material.

In an embodiment, the friction components are metal material.

In an embodiment, the friction components are a composite material.

In a further embodiment, one or more energy storage components are disposed to store mechanical energy and release the mechanical energy upon the elimination of the temporary component.

In an embodiment, the energy storage component is a spring.

The system will be understood from the accompanying drawings, taken in conjunction with the accompanying description. Several embodiments of the system may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The system of the present application is illustrated in the associated drawings. As used herein, "system" and "assembly" are used interchangeably. As used herein, a "fastener" is a rod-like hardware device that mechanically joins or affixes two or more members together through a respective concentric set of apertures. For example, a fastener can be a screw, bolt, nail, stud, dowel, rivet, staple, etc. in conjunction with any applicable nuts and washers generally known in the art of fastening. It should be noted that the articles "a", "an", and "the", as used in this specification, include plural referents unless the content clearly dictates otherwise. Additional features and functions are illustrated and discussed below.

Referring now to the drawings wherein like reference characters identify corresponding or similar elements in form and function throughout the several views.

Referring now to FIG. 1, a perspective view of ring assembly 100 is illustrated in accordance with an embodiment of the present invention.

Figure 1A:
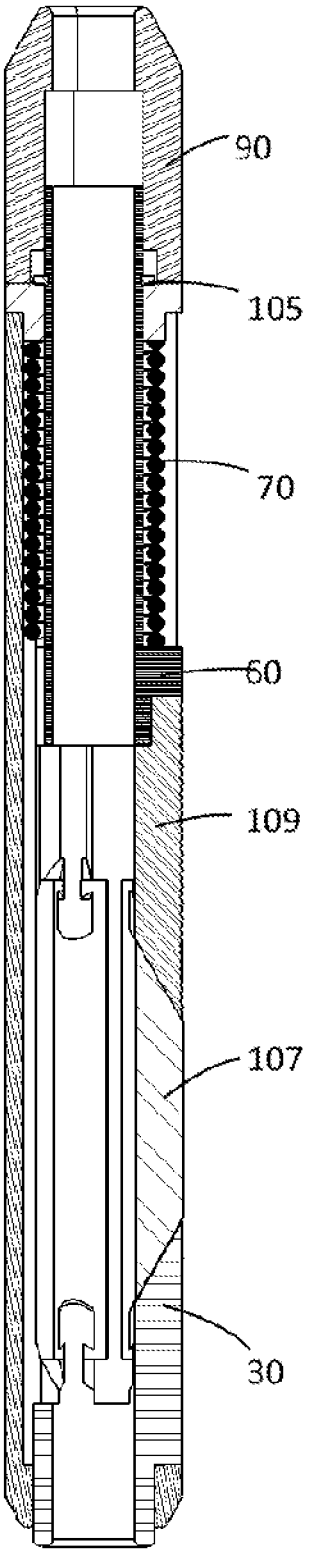
FIG. 1A is a cross-section view of the standoff assembly of FIG. 1 taken about line A of FIG. 1.
Figure 2:
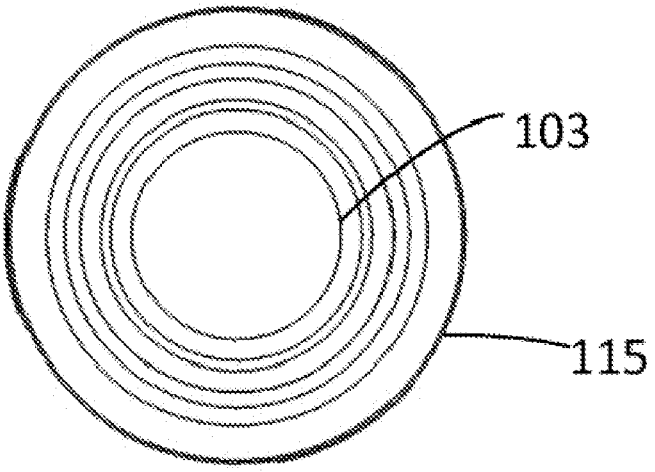
FIG. 2 is an end view of the standoff assembly of FIG. 1; noting the inner and outer surface.
Figure 3:
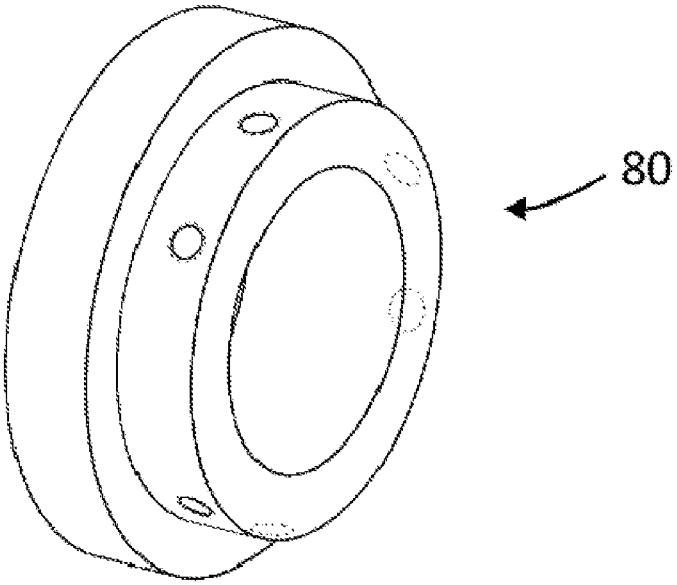
FIG. 3 is a component of the standoff assembly of FIG. 1; the spring retainer.
Figure 4:
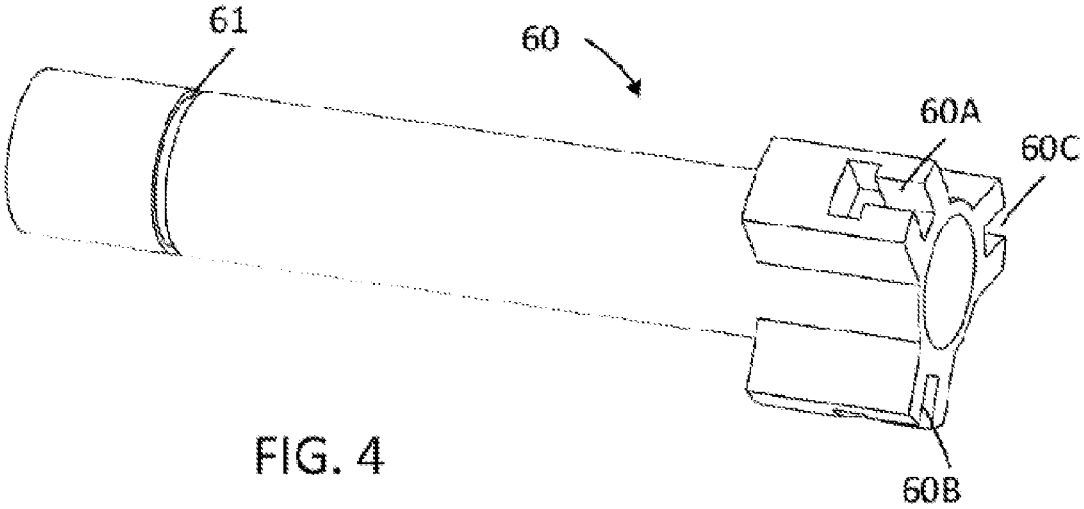
FIG. 4 is a component of the standoff assembly of FIG. 1; the upper actuator.
Figure 5:
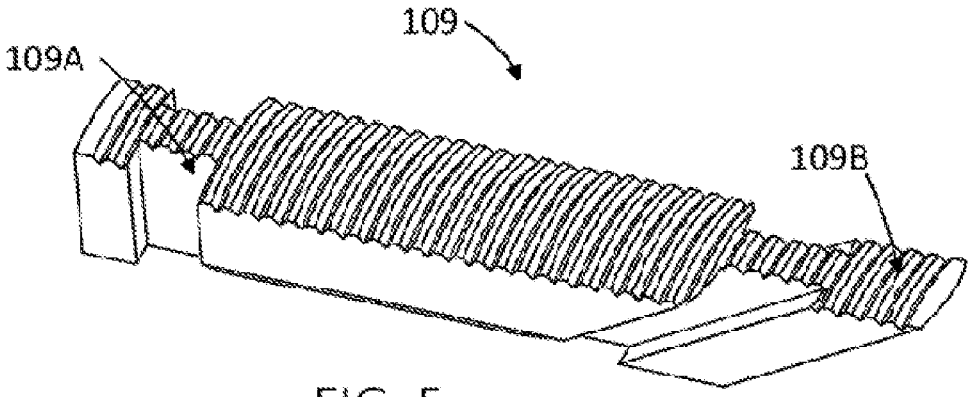
FIG. 5 is a component of the standoff assembly of FIG. 1; a friction component.
Figure 6:
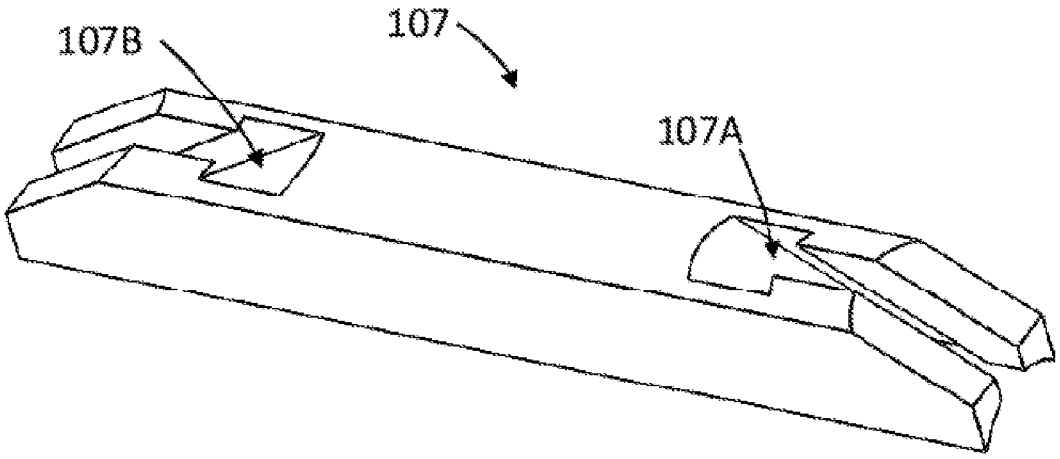
FIG. 6 is a component of the standoff assembly of FIG. 1; a sliding material component.
Figure 7:
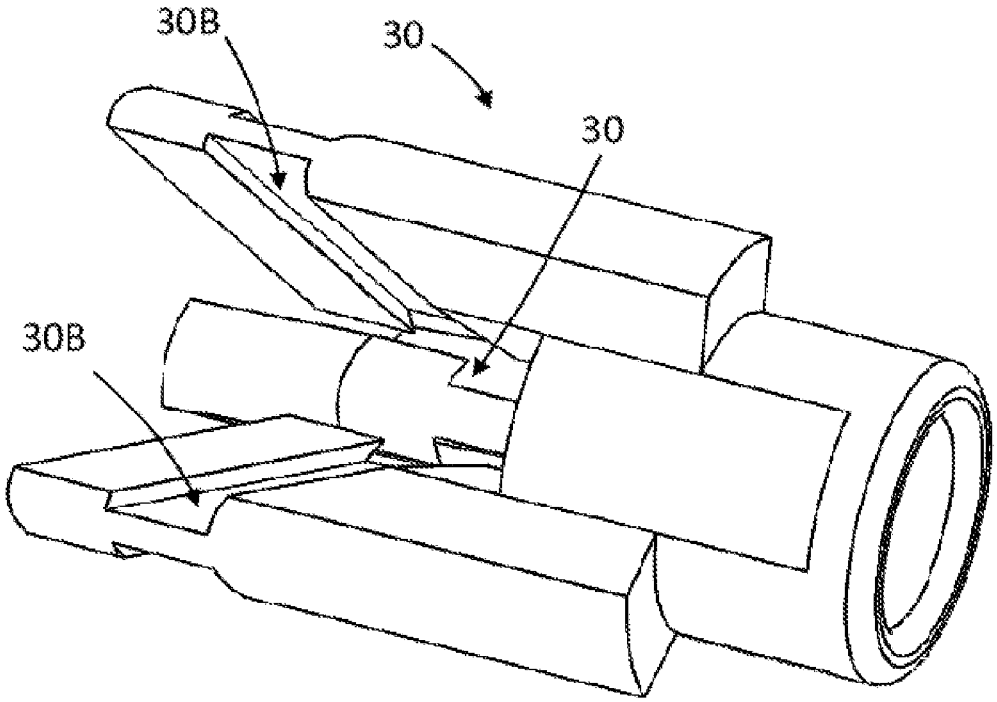
FIG. 7 is a component of the standoff assembly of FIG. 1; the lower actuator.
Figure 8:
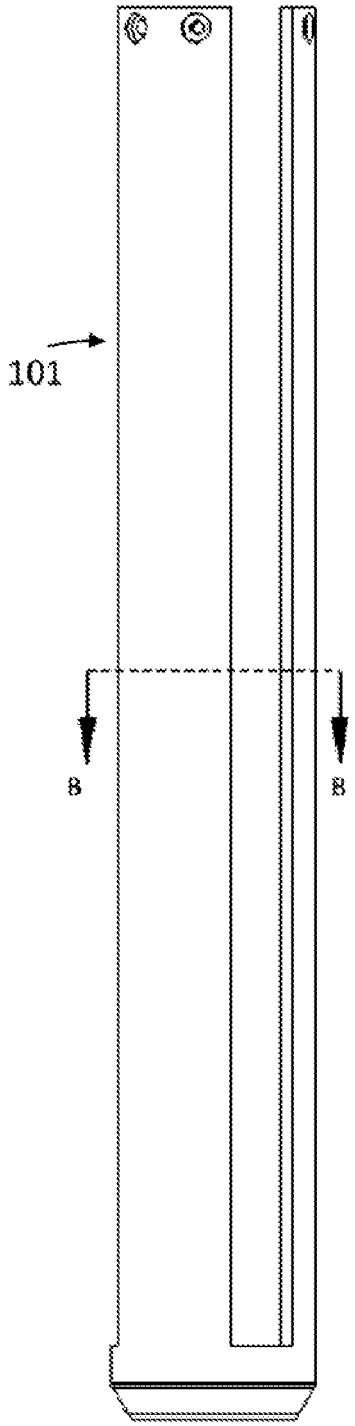
FIG. 8 is a component of the standoff assembly of FIG. 1; the annular body.
Figure 8A:
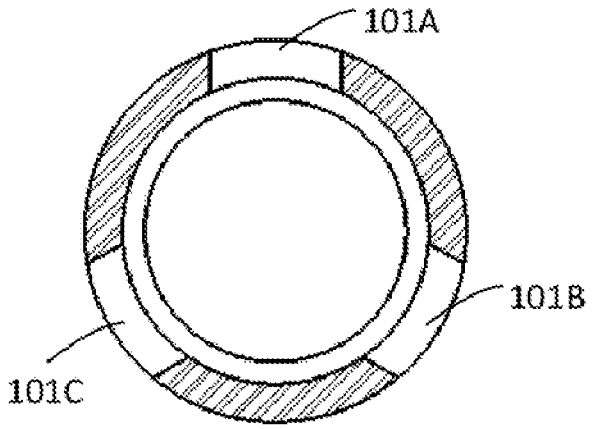
FIG. 8A is a cross-section view of the component of FIG. 8 taken about line B of FIG. 8.

With reference to FIG. 1 and FIG. 1A, standoff assembly 100 includes, but is not limited to, annulus body 101, temporary component 105, sliding material component 107, and friction pad 109. Annulus body 101 consists of a plurality of annular cutouts (i.e., annular cutouts 101A, 101B and 101C in FIG. 8A) that retain lower actuator 30, sliding material components 107, friction pads 109 and upper actuator 60; forming inner surface 103 as indicated in FIG. 2. Sliding material component 107 is in mechanical communication with annulus body 101, and is a material that permits a sucker rod to translate through hole 103 with a reduced friction force as compared to friction forces that would normally arise between annulus body 101 and the sucker rod without sliding material component 107 present. For example, sliding material component 107 can be, but is not limited to, Polytetrafluoroethylene (PTFE) or a ball bearing device. The components additionally form an outer surface 115. Spring retainer 80 is fastened with fasteners 95 to an end of annular body 101. A spring 70 is retained in compression between spring retainer 80 and upper actuator 60. As shown in FIG. 4, upper actuator 60 comprises T-slots 60A, 60B and 60C; a tube which extends along the long axis of the standoff assembly and a groove 61 at the opposing end of the T-slots. Mating T-profiles 109A of friction pads 109 each reside within a T-slot of the upper actuator 60 and are radially moveable (see FIG. 5). At the opposing end of the friction pads 109, angled T-profiles 109B are each mated and slidable within angled T-slots 107B of sliding material component 107 (see FIG. 6). On the opposing ends of sliding material components 107, second angled T-slots 107A are each mated and slidable onto angled T-profiles 30B of lower actuator 30 (see FIG. 7). Rod clamp 90 is fixed to the sucker rod such that when temporary component 105 is eliminated, stored energy within spring 70 acts upon upper actuator 60 and the aforementioned T-slots and T-profiles of their respective components act in conjunction to radially extend friction pads toward the tubing and radially extend sliding material components toward the sucker rod.

Figure 9:
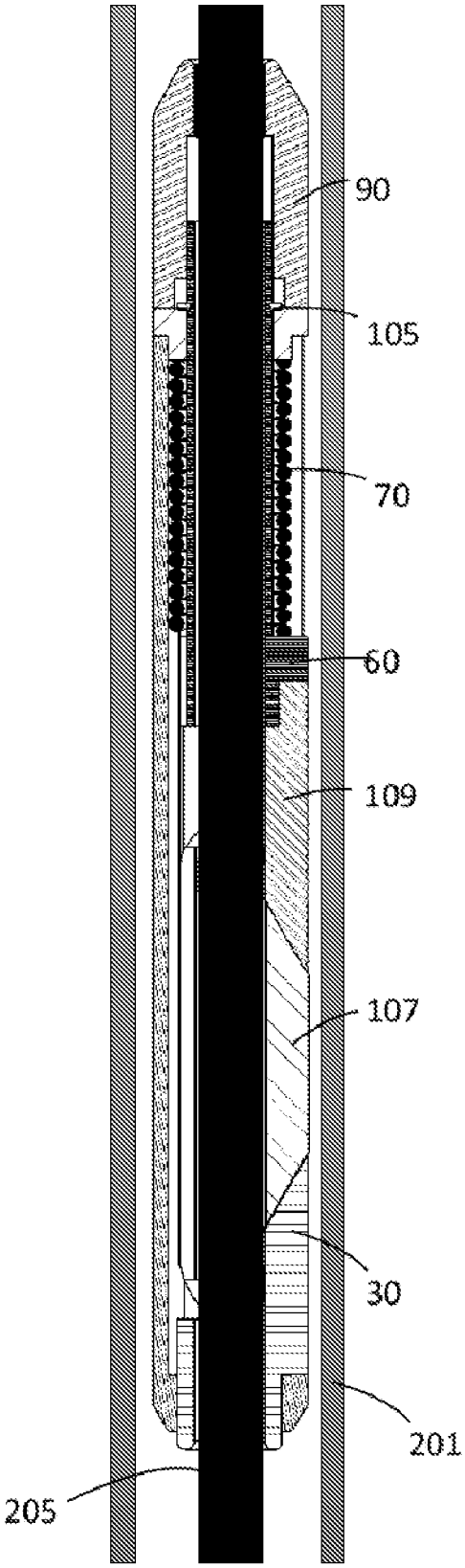
FIG. 9 is a cross-section view of the standoff assembly positioned on a sucker rod and in a tubular.

FIG. 9 shows the standoff assembly in the run-in-hole state positioned on a sucker rod 205 and inside a tubular 201. The spring 70 is storing maximum energy. The temporary component is in the initial state and the friction pads and sliding material components are retracted.

Figure 10:
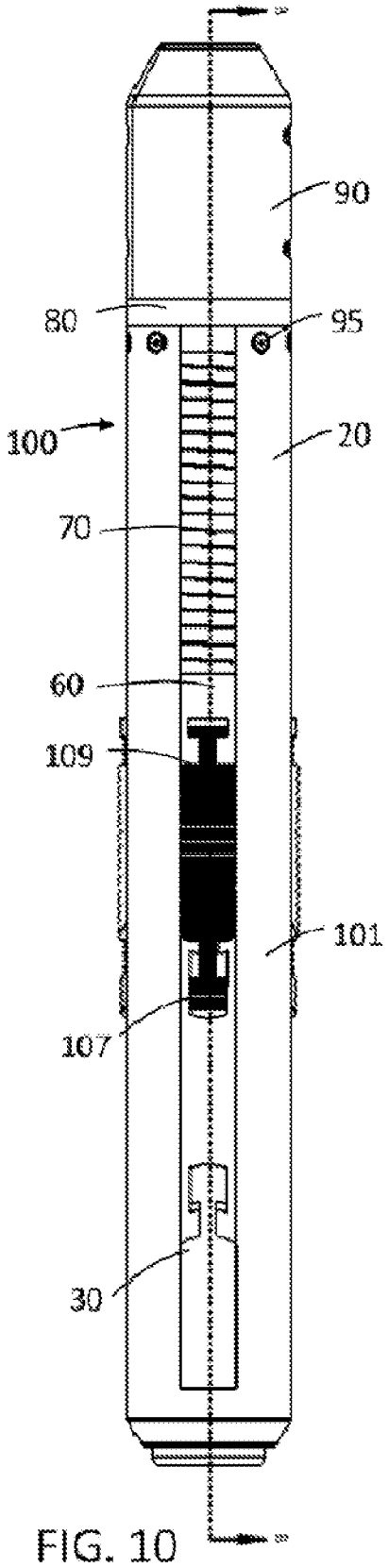
FIG. 10 is a view of a standoff assembly in the actuated state.
Figure 10A:
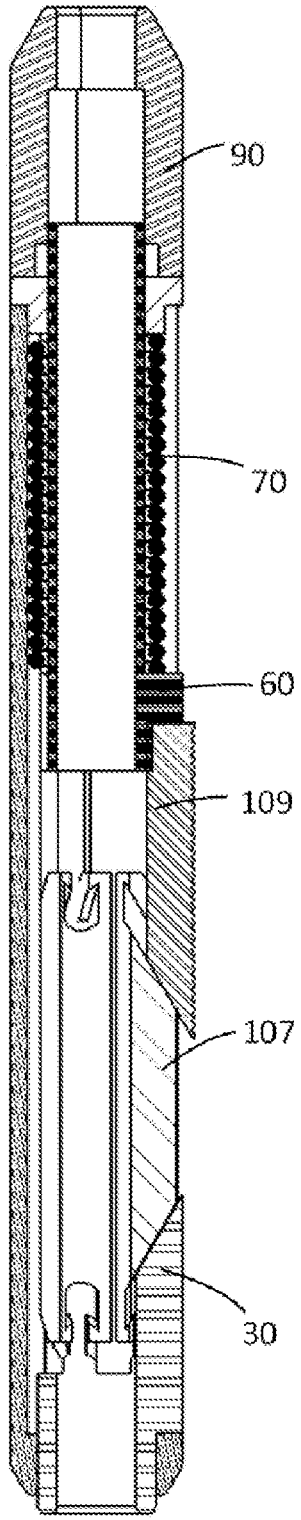
FIG. 10A is a cross-section view of the standoff assembly of FIG. 10 taken about line B of FIG. 10.
Figure 11:
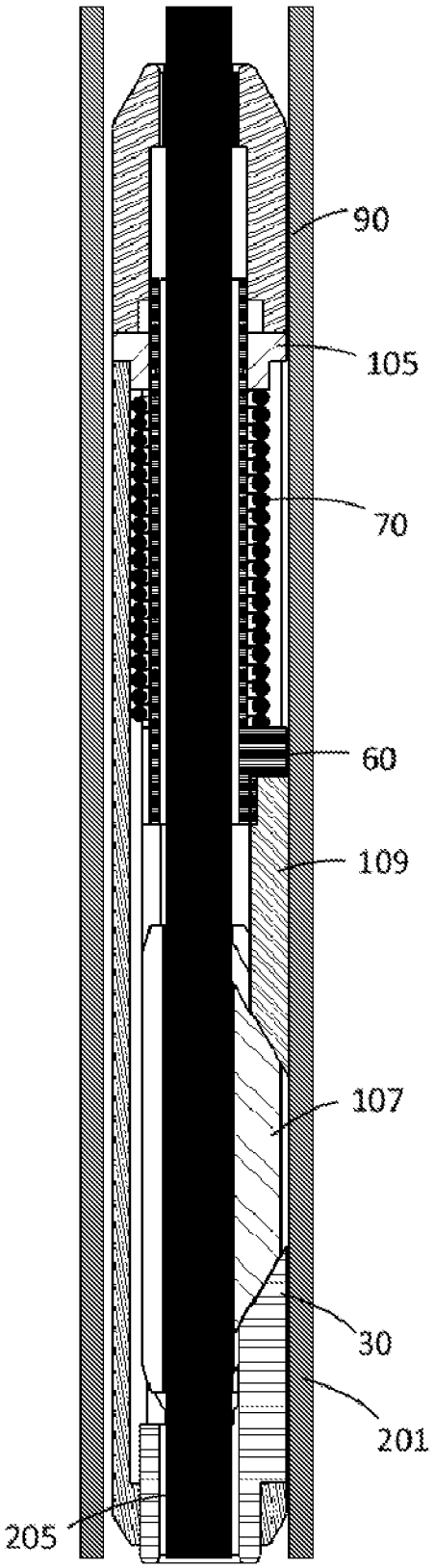
FIG. 11 is a cross-section view of the standoff assembly positioned on a sucker rod, in a tubular and in the actuated state.

In FIG. 10, the standoff assembly is in the actuated position after the temporary component 105 is eliminated. With reference to FIG. 11 where the standoff assembly is shown in the working state; the friction pads are engaged with the tubular 201 and the sliding material component 107 is in working contact with the sucker rod 205. In this way, the standoff assembly functions to eliminate contact between the sucker rod and the tubing while minimizing friction forces as the sucker rod translates therethrough. As the sliding material components wear with each translation of the sucker rod assembly through the standoff assembly 100, spring 80 continues to provide a force upon the upper actuator 60 to further radially actuate the sliding material components 107 to continually engage the sucker rod 205 until such point that the angled T-slots 107A and 107B cease to interact with the mating T-slot profiles 109B and 30B of friction pad 109 and lower actuator 30, respectively.

Figure 12:
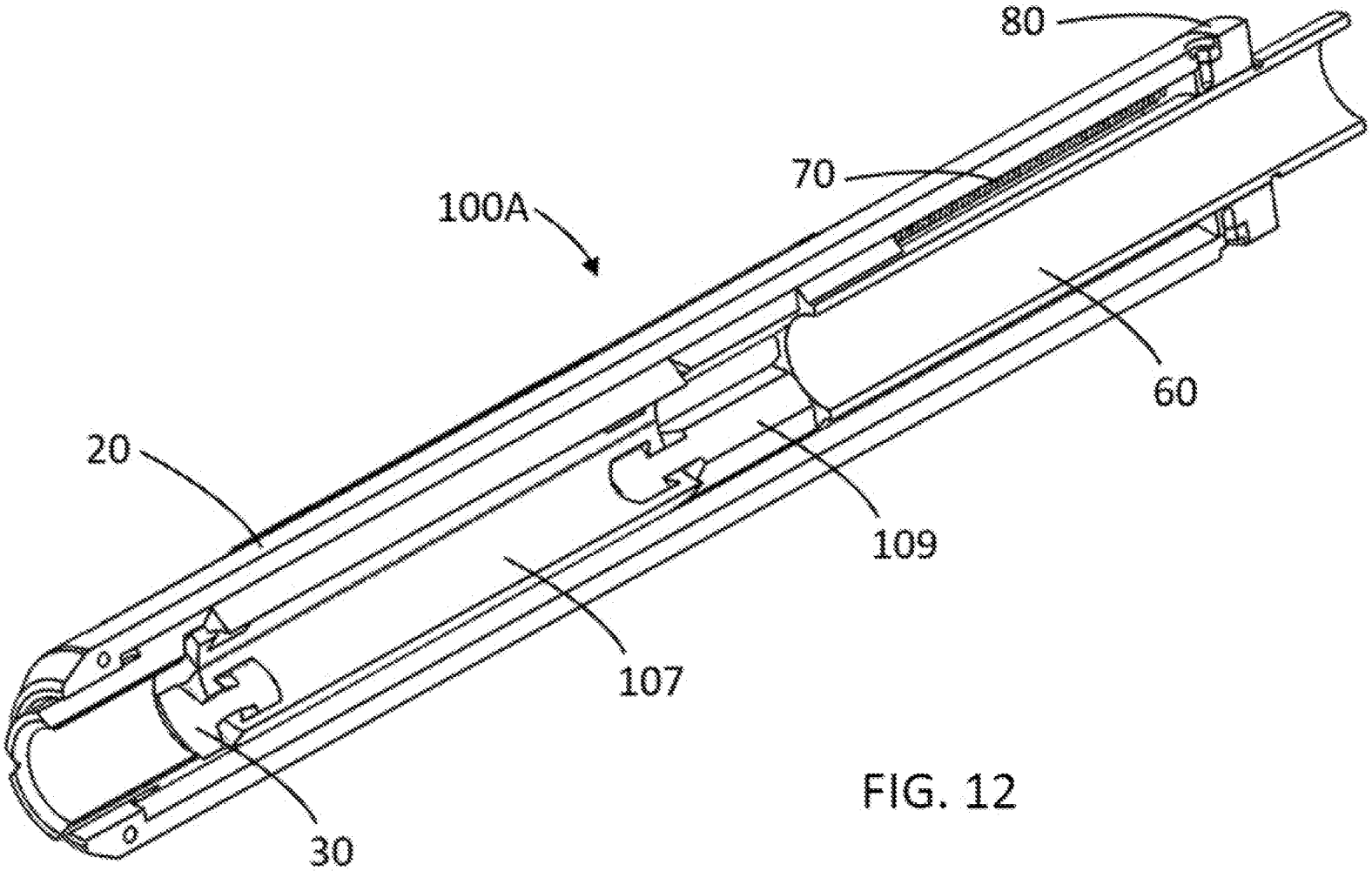
FIG. 12 is a view of an embodiment of half of a split standoff assembly.
Figure 13:
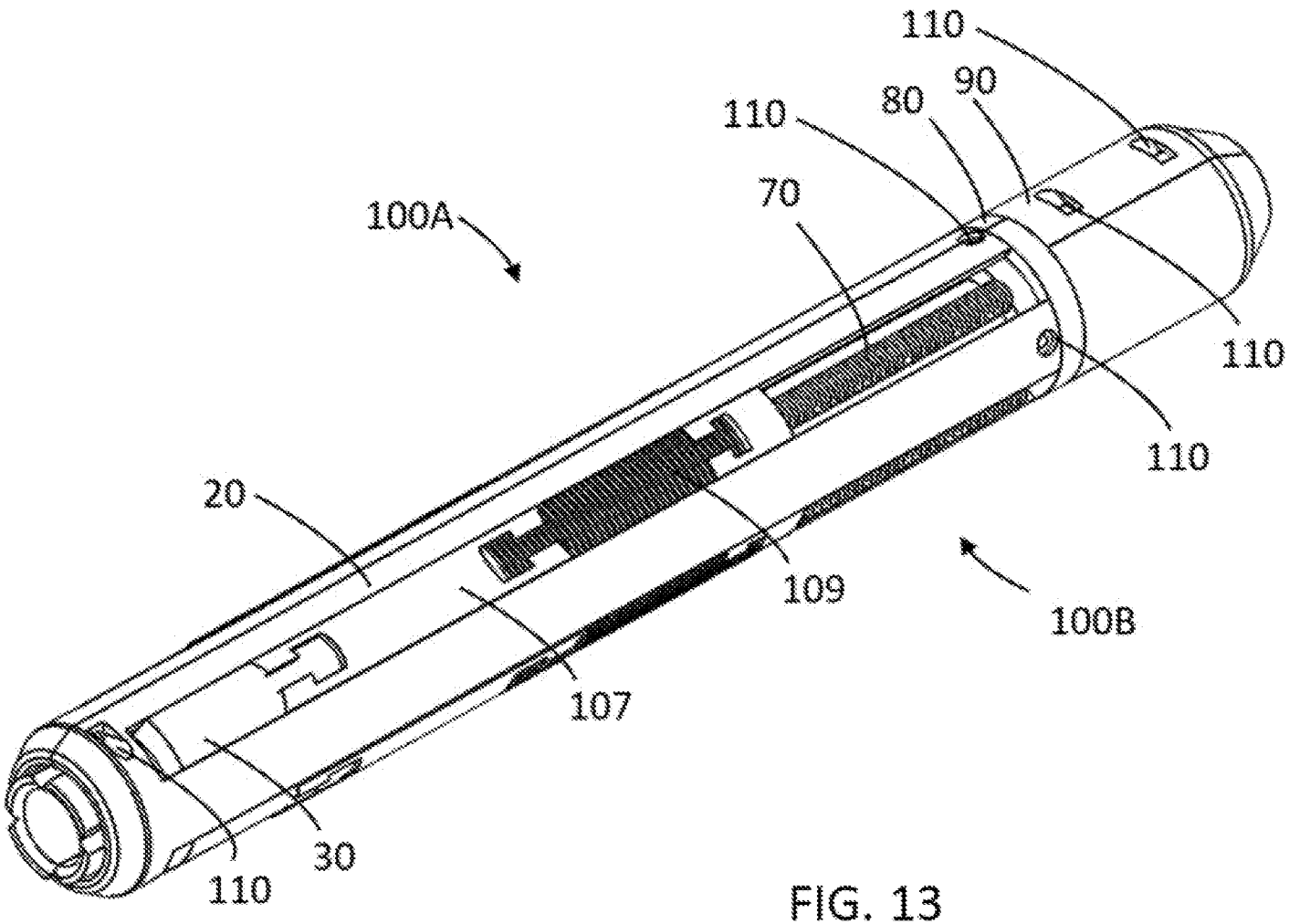
FIG. 13 is a view of an embodiment of a split standoff assembly.

In an embodiment, the standoff assembly is comprised of two halves that may be placed on a sucker rod and secured to the other. FIG. 12. is an embodiment of half of a standoff assembly, 100A. When secure to a second and mating half with fasteners at fastening locations 110, the standoff assembly appears as in FIG. 13.

In an embodiment, the standoff assembly is comprised of three, four, five, six or more sections that may be placed on a sucker rod and secured to the other.

In an embodiment, one or more springs are disposed to each actuate a friction pad radially towards the inner surface of a tubular and actuate an associated wear pad in an opposing radial direction to interact with a sucker rod.

A method for using a sucker rod standoff assembly includes: securing a standoff assembly to a sucker rod, the standoff assembly comprising; a sliding material component, a friction component, an energy storage component and a temporary component; running the sucker rod with secured standoff assembly inside a well bore to a desired location; eliminating the temporary component of the standoff assembly; the energy storage component applying a force to the friction; wherein the applied force actuates the friction component to interact with a surrounding tubular and actuates the sliding material component to interact with the sucker rod.

Figure 14:
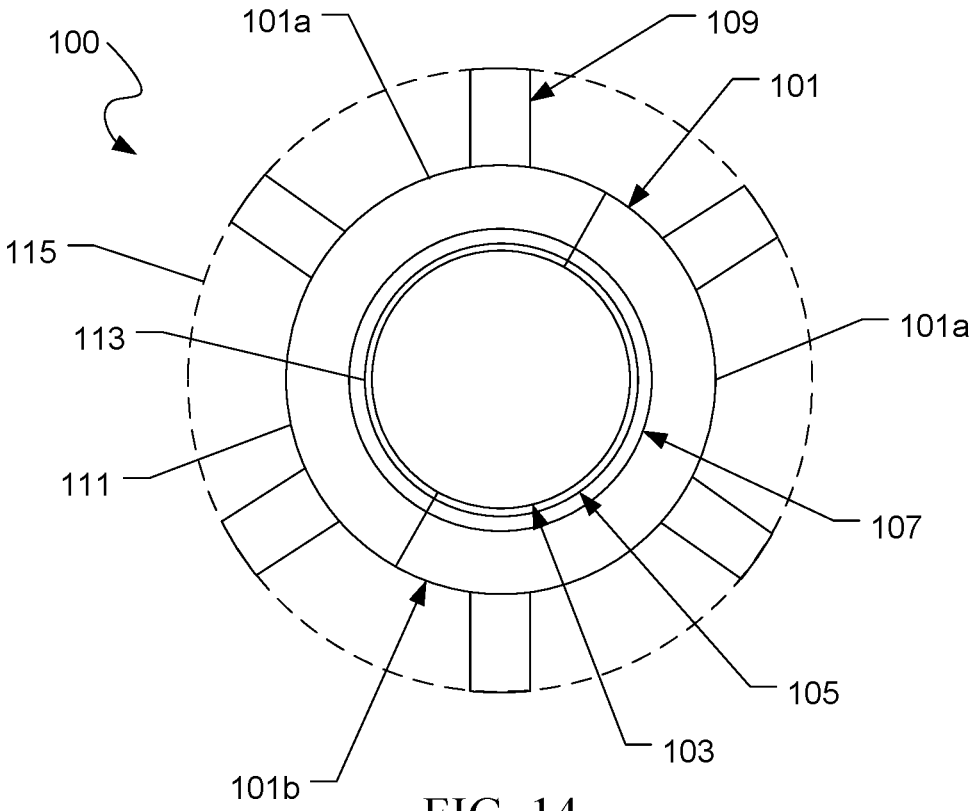
FIG. 14 is a top view of an alternative embodiment of a standoff assembly.

In an alternative embodiment in FIG. 14, standoff assembly 100 includes, but is not limited to, annulus body 101, temporary component 105, sliding material component 107, and friction components 109. Annulus body 101 consists of a plurality of annulus segments (i.e., annulus segments 101*a* and 101*b*) that, when conjoined (as shown in the figure), form annulus body 101. In this example, annulus body 101 is comprised of two half pipes that are fastened together. Annulus body 101 has a first surface (i.e., surface 111) and a second surface (i.e., surface 113), the first surface having an outer diameter (i.e., diameter 112; further illustrated in FIG. 15), the second surface corresponding to a hole (i.e., hole 103) that passes through annulus body 101. Hole 103 has an inner diameter configured to permit a sucker rod to translate through hole 103. The inner diameter of hole 103 may come in various sizes to accommodate various sucker rod diameters. Optionally, surface 111 may be rubber.

Sliding material component 107 is located along second surface 113. Sliding material component 107 is in communication with annulus body 101, and is any device or material that permits a sucker rod to translate through hole 103 with a reduced friction force as compared to friction forces that would normally arise between annulus body 101 and the sucker rod without sliding material component 107 present. For example, sliding material component 107 can be, but is not limited to, Polytetrafluoroethylene (PTFE) or a ball bearing device.

Temporary component 105 is a temporary component that covers sliding material component 107. Temporary component 105 is configured to form an interference fit with the sucker rod, thereby restricting the sucker rod from translating through annulus body 101. Temporary component 105 is a temporary component that is later removed to permit the sucker rod to translate through annulus body 101 against sliding material component 107. Temporary component 105 is made of a removable material. For example, temporary component 105 can be a plastic material that dissolves after a period of time, a plastic material that degrades after a number of cycles of a sucker rod pump, or can be a material that breaks down in response to an electrical discharge. This feature allows the coupled standoff assembly 100 and sucker rod to reach a desired depth without standoff assembly 100 sliding along the sucker rod, but after arriving to the desired depth, temporary component 105 is removed, thereby allowing the sucker rod to translate through standoff assembly 100.

Friction components 109 are a plurality of friction components located along surface 111 and extend outward from annulus body 101. Friction components 109 extend outward to a friction component diameter (i.e., friction component diameter 115). Optionally, standoff assembly 100 may not have friction components 109.

Figure 15:
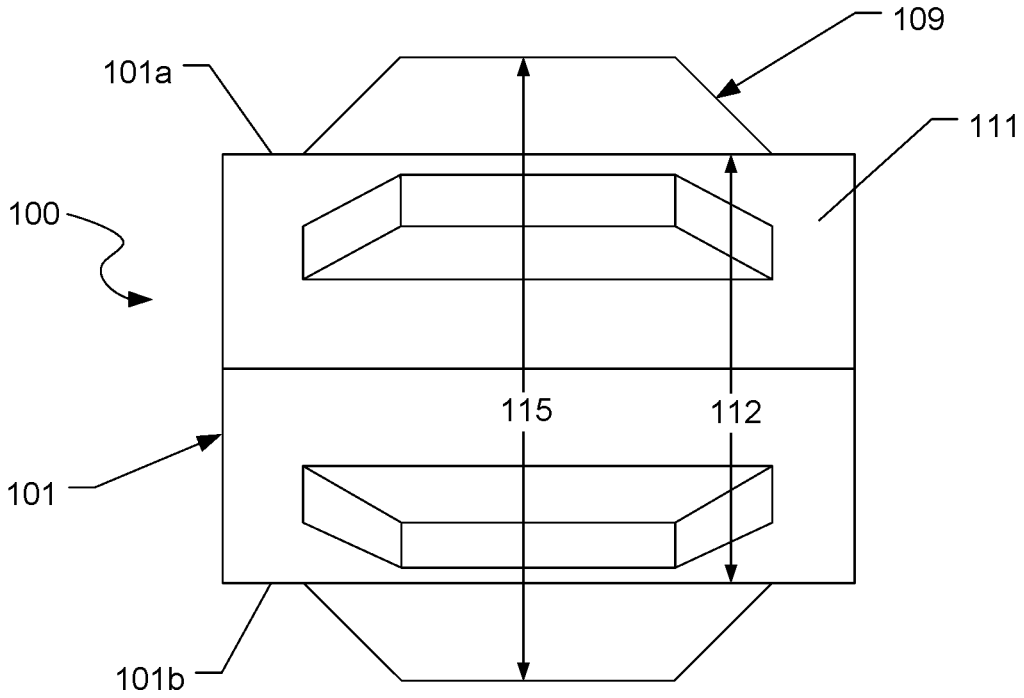
FIG. 15 is a side view of the standoff assembly of FIG. 14.

Referring now to FIG. 15, a side view of standoff assembly 100 of FIG. 14 is illustrated. In this figure, diameter 112 is the outer diameter of annulus body 101

Figure 16:
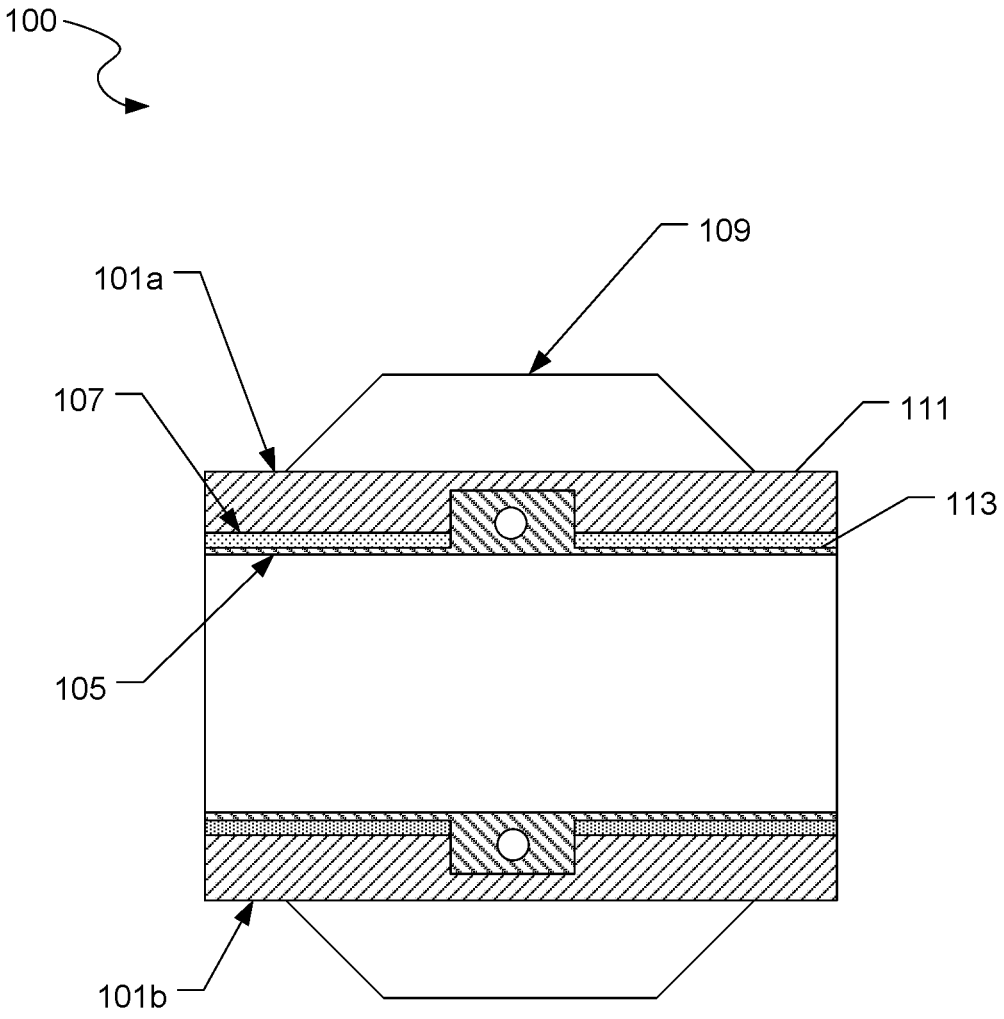
FIG. 16 is a cross sectional view of the standoff assembly of FIG. 14.

Referring now to FIG. 16, a cross sectional view of standoff assembly 100 of FIG. 14 is illustrated.

Figure 17:
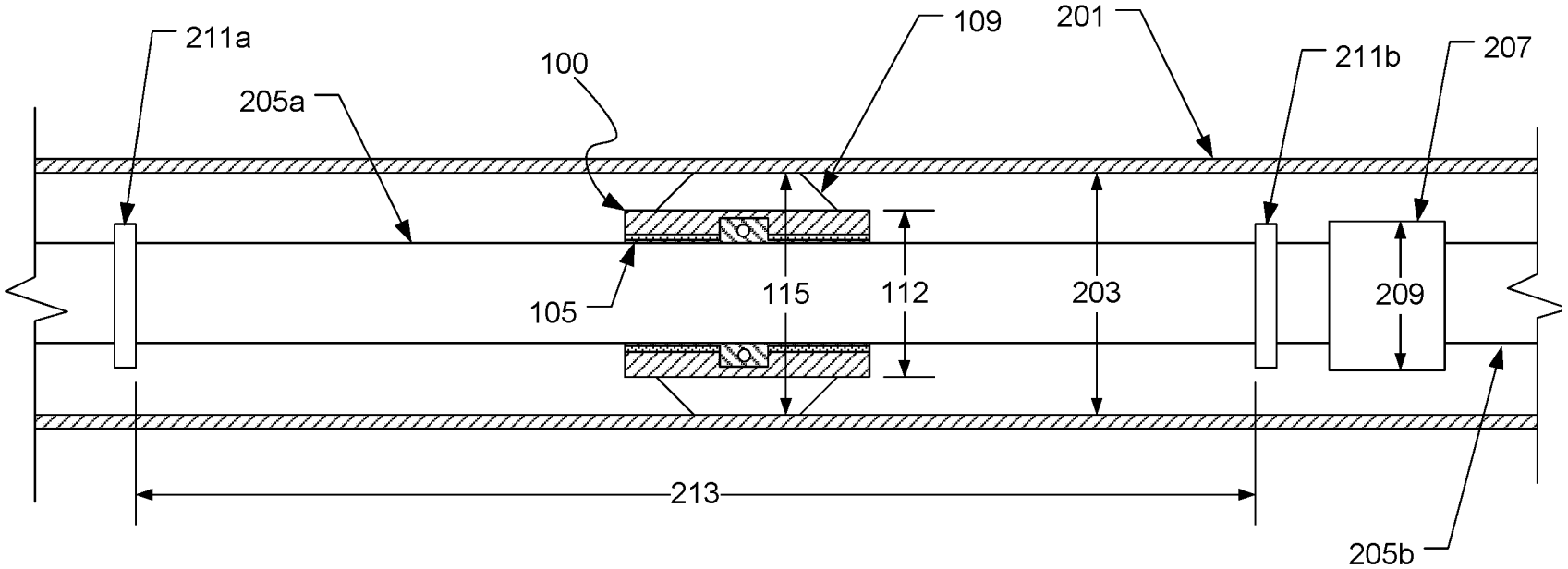
FIG. 17 is an exemplary setup illustrating a cross sectional view of a well tube housing a sucker rod coupled with the standoff assembly of FIG. 14.

Referring now to FIG. 17, exemplary setup 200 illustrates a cross sectional view of a well tube housing a sucker rod that is coupled with standoff assembly of FIG. 14.

In this figure, standoff assembly 100 is coupled to sucker rod 205*a*. Sucker rod 205*a* is connected to an adjacent sucker rod (i.e., sucker rod 205*b*) via sucker rod connection 207. Sucker rod connection 207 has diameter 209. In this figure, the coupled standoff assembly 100 and sucker rod 205 (and subsequently connected sucker rods) are inserted into production tubing 201. Production tubing 201 is a tubing known in the art generally used for the extraction of oil or other liquid resources. Production tubing 201 has drift diameter 203.

In general, friction component diameter 115 of standoff assembly 100 is greater than diameter 209 of sucker rod connection 207. Friction component diameter 115 is also less than drift diameter 203 of production tubing 201. In the optional scenario where standoff assembly 100 does not have friction components 109, then diameter 112 of standoff assembly 100 is greater than diameter 209 and is less than drift diameter 203.

Temporary component 105 maintains coupling between standoff assembly 100 and sucker rod 205*a* via an interference fit, thereby resisting any relative motion between standoff assembly 100 and sucker rod 205*a*. However, once temporary component 105 is removed or eliminated, then sucker rod 205*a* is permitted to translate through standoff assembly 100 since the interference fit is removed. As the rod pump goes through its cyclical up and down motion, standoff assembly 100 remains in place within production tubing 201. A user may place as many standoff assemblies as desired. In some instances, standoff assembly 100 may be used only in a deviated section of an oil well. In other instances, standoff assembly 100 may run along the entire length of sucker rod 205*a* to obtain full benefit of reduced friction and complete electrical isolation between sucker rod 205*a* and production tubing 201.

As a method of using standoff assembly 100 of FIG. 17, a user fastens two or more segments of the assembly (i.e., annulus segments 101*a-b*) to form annulus body 101, wherein sucker rod 205*a* is positioned within hole 103 that passes through standoff assembly 100. Optionally, stop plates may be coupled to a sucker rod to maintain standoff assembly 100 within a local region of the rod. In this example figure, stop plates 211*a* and 211*b* are positioned distance 213 along sucker rod 211 while standoff assembly 100 is located between stop plates 211*a-b*. Distance 213 corresponds to a stroke length of a sucker rod pump.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A standoff assembly for a sucker rod, comprising:

an annulus body having a first surface and a second surface, the first surface having an outer diameter, the second surface corresponding to a hole that passes therethrough, the hole having an inner diameter configured to permit a sucker rod to translate through the hole;

a sliding material component;

a friction component disposed to interact with a surrounding tubular; and a temporary component;

wherein upon elimination of the temporary component, the sliding material component interacts with the sucker rod.

2. The assembly of claim 1, wherein the friction component interacts with the surrounding tubular upon elimination of the temporary component.

3. The assembly of claim 1, comprising:

a plurality of friction components circumferentially located about the assembly.

4. The assembly of claim 3, wherein the plurality of friction components are rubber.

5. The assembly of claim 3, wherein the plurality of friction components are metal.

6. The assembly of claim 1, comprising:

a plurality of sliding material components circumferentially located about the standoff assembly.

7. The assembly of claim 1, further comprising:

one or more energy storage components disposed to store mechanical energy and release the mechanical energy upon the elimination of the temporary component.

8. The assembly of claim 7, wherein in the energy storage component is a spring.

9. The assembly of claim 1, wherein the sliding material are ball bearings.

10. The assembly of claim 1, wherein the temporary component is a metal material that dissolves after a period of time.

11. The assembly of claim 1, wherein the temporary component is a plastic material that dissolves after a period of time.

12. The assembly of claim 1, wherein the temporary component is a plastic material that degrades after a number of cycles of a sucker rod pump.

13. The assembly of claim 1, wherein the temporary component is a material that breaks down in response to an electrical discharge.

14. The assembly of claim 1, wherein the outer diameter of the first surface is greater than a diameter of a rod connection joint that connection the sucker rod to a second sucker rod.

15. The assembly of claim 1, wherein the outer diameter is less than a drift diameter of a tube for receiving the sucker rod.

16. The assembly of claim 1, wherein the annulus body is composed of two or more segments of an annulus that are combined and fastened to form the annulus body.

17. A method for using a standoff assembly for a sucker rod, the method comprising:

securing a standoff assembly to a sucker rod, the standoff assembly comprising; a sliding material component, a friction component, an energy storage component and a temporary component;

running the sucker rod with secured standoff assembly inside a well bore to a desired location; and the energy storage component applying a force to the friction component upon elimination of the temporary component;

wherein the applied force actuates the friction component to interact with a surrounding tubular and actuates the sliding material component to interact with the sucker rod.

* * * * *